US009951467B2

(12) United States Patent
Katoh et al.

(10) Patent No.: US 9,951,467 B2
(45) Date of Patent: Apr. 24, 2018

(54) BACTERIOSTATICALLY TREATING METHOD

(75) Inventors: Reiko Katoh, Yokohama (JP); Naoyuki Yoshida, Tokyo (JP); Masamichi Mutoh, Yokohama (JP)

(73) Assignee: JNC CORPORATION, Tokyo (JP)

( * ) Notice: Subject to any disclaimer, the term of this patent is extended or adjusted under 35 U.S.C. 154(b) by 289 days.

(21) Appl. No.: 12/972,055

(22) Filed: Dec. 17, 2010

(65) Prior Publication Data

US 2011/0151131 A1 Jun. 23, 2011

(30) Foreign Application Priority Data

Dec. 17, 2009 (JP) ..... 2009-285893

(51) Int. Cl.

| | |
|---|---|
| ***D06M 15/15*** | (2006.01) |
| ***D06M 16/00*** | (2006.01) |
| ***B05D 1/18*** | (2006.01) |
| ***B05D 5/00*** | (2006.01) |

(52) U.S. Cl.
CPC ..... *D06M 16/00* (2013.01); *B05D 1/18* (2013.01); *D06M 15/15* (2013.01)

(58) Field of Classification Search
USPC ..... 8/115.51; 427/430.1
See application file for complete search history.

(56) References Cited

U.S. PATENT DOCUMENTS

| | | | | |
|---|---|---|---|---|
| 5,759,844 | A * | 6/1998 | Hiraki et al. | 435/259 |
| 2001/0055651 | A1* | 12/2001 | Mao et al. | 427/434.6 |
| 2007/0003538 | A1* | 1/2007 | Madhyastha | 424/94.61 |

FOREIGN PATENT DOCUMENTS

| | | | |
|---|---|---|---|
| JP | 08170217 | A * | 7/1996 |
| JP | 09-220416 | A | 8/1997 |
| JP | 10-310935 | A | 11/1998 |
| JP | 11-061639 | A | 3/1999 |
| JP | 11061639 | A * | 3/1999 |
| JP | 2001-146681 | A | 5/2001 |
| JP | 2003-166155 | A | 6/2003 |
| JP | 3596147 | B2 | 12/2004 |
| JP | 2005-314823 | A | 11/2005 |
| JP | 3883763 | B2 | 2/2007 |
| JP | 2007254936 | A * | 10/2007 |
| JP | 2008-303287 | A | 12/2008 |

OTHER PUBLICATIONS

English text machine translation of Kato (JP 08-170217 A), accessed from the JPO AIPN website on Aug. 1, 2015 and attached to the case file as a PDF.*

English text machine translation of Kato (JP 2007-254936 A), accessed from the astamuse.com website on Aug. 1, 2015 and attached to the case file as a PDF.*

L-lysine entry from the PubChem Open Chemistry database, accessed online from the website http://pubchem.ncbi.nlm.nih.gov/ on Aug. 1, 2015 and is attached to the case file as a PDF.*

English text machine translation of Inoue (JP 11-061639 A); accessed from the JPO AIPN website, attached to the case file as a PDF, pp. 1-5. (Year: 1999).*

Motohiro, Terushige, 1989, Antibacterial Property of Protamine and Development of Food Preservation Agent, Bio Industry, vol. 6, No. 2, pp. 5-17 [English Abstract, Japanese article].

S. Shima, et al., "Antimicrobial Action of E-Poly-L-Lysine," The Journal of Antibiotics, vol. XXXVII, No. 11, pp. 1449-1455.

JNC, "Polylysine," Life Chemicals Sales Dept. Products.

* cited by examiner

*Primary Examiner* — Katie L Hammer
(74) *Attorney, Agent, or Firm* — Hogan Lovells US LLP

(57) ABSTRACT

The present invention provides a method for imparting bacteriostatic effect to a textile product by immersing the textile product for 20 minutes or more in an aqueous solution containing a cationic polypeptide at a concentration of 250 ppm or more, which solution has a temperature of 25° C. or more. By bacteriostatically treating a textile product in accordance with such method, the bacteriostatic effect is not reduced and thus retained even after the textile product is washed for a plurality of times.

6 Claims, No Drawings

BACTERIOSTATICALLY TREATING METHOD

This nonprovisional application claims priority under 35 U.S.C. § 119(a) on patent application No. 2009-285893 filed in Japan on Dec. 17, 2009, the entire contents of which are hereby incorporated by reference.

TECHNICAL FIELD

The present invention relates to a method for bacteriostatically treating a textile product.

BACKGROUND ART

Due to sweating and contaminants in the air, it is easy for bacteria to grow on those textile products that come into contact with human body, such as clothings, towels and bedclothes. As a result, such bacterial growth causes dermatopathy and unpleasant phenomenon due to the offensive odor generated by the decomposed matters of bacteria, as well as alteration, discoloration and deterioration of the fibers. Particularly, since synthetic fibers absorbs only a small amount of sweat, there is a problem that microorganisms are likely to grow on such textile product due to the sweat deposited when the textile product is worn.

Partly because of the recent increase in the recognition and orientation toward hygiene among consumers in general, a number of methods for imparting antimicrobial properties to a textile product have been devised. Examples of such methods include one in which the spinning solution is kneaded with an antimicrobial agent and spun into fibers and one in which fibers are impregnated with a solution of antimicrobial agent.

As the antimicrobial agent used in such the above-mentioned methods for imparting antimicrobial properties to a textile product, cationic polypeptides such as ϵ-polylysine and protamines, which are also used as food additives, are highly safe and useful. It is noted here that the term "protamine" collectively refers to histone-like peptides originated from fish sperm nucleus, and specifically, it is a peptide having an arginine-rich structure.

Examples where ϵ-polylysine was used so far include those in which a spinning solution, such as polypropylene or polyethylene, was kneaded with ϵ-polylysine and spun into fibers (Japanese Unexamined Patent Application Publication No. H10-310935, Japanese Patent No. 3596147); one in which ϵ-polylysine was graft-polymerized into a macromolecule (Japanese Unexamined Patent Application Publication No. 2008-303287); and the method in which fibers are impregnated with a solution containing ϵ-polylysine solution and other components (Japanese Unexamined Patent Application Publication No. 2005-314823, Japanese Patent No. 3883763, Japanese Unexamined Patent Application Publication No. H11-61639). In addition, examples where protamine was used include the method in which protamine is applied as an antifungal agent and allowed to adhere to a nonwoven fabric (Japanese Unexamined Patent Application Publication No. 2003-166155).

Among these methods, since the bacteriostatically treating method in which an antibacterial agent is attached to fibers by impregnation or application is particularly simple, it is desired to generalize the use thereof.

However, in the treatment conditions of the aforementioned prior arts, the bacteriostatic effect cannot be maintained as the antibacterial agent is removed during washing; thus, components other than cationic polypeptide are allowed to exist during the treatment. That is, there has not been achieved a method for bacteriostatically treating a textile product in such a manner that the bacteriostatic effect of the antibacterial agent is not reduced and thus retained even after the textile product is washed for a plurality of times.

SUMMARY OF THE INVENTION

An object of the present invention is to provide a method for bacteriostatically treating a textile product using a cationic polypeptide in such a manner that the bacteriostatic effect is not reduced and thus retained even after the textile product is washed for a plurality of times.

In order to solve the aforementioned problems, the present inventors carried out intensive studies. As a result, it was discovered that a textile product, which was immersed at a specific temperature for a specific time period in an aqueous solution containing a cationic protein at a specific concentration range, retains high antibacterial activity even after being washed for a plurality of times. Based on such discovery, the present inventors completed the present invention.

That is, the present invention is as follows.

By bacteriostatically treating a textile product in accordance with the method of the present invention, the bacteriostatic effect based on the cationic polypeptide is not reduced and thus can be retained even after the textile product is washed for a plurality of times.

DESCRIPTION OF THE PREFERRED EMBODIMENTS

The cationic polypeptide used in the method of the present invention comprises basic amino acids as the main component, and in the composition, the amount of the basic amino acid is 60 mol % or more, preferably 70 mol % or more, more preferably 80 mol % or more. As such cationic polypeptide, ϵ-polylysine, protamines and the like are preferred. Further, the molecular weight of these cationic polypeptides is not particularly restricted, however, it is preferably 1,000 to 5,000.

The ϵ-polylysine which can be used in the method of the present invention is obtained, for example, by culturing in a medium *Streptomyces albulus* subsp. *lysinopolymerus*, which is a polylysine-producing bacterium belonging to the genus *Streptomyces* and subsequently isolating and collecting ϵ-polylysine from the thus obtained culture as described in Japanese Examined Patent Application Publication No. S59-20359.

In the present invention, ϵ-polylysine can be used in the free form. Also, ϵ-polylysine can be used in the form of a salt of at least one inorganic acid selected from hydrochloric acid, sulfuric acid, phosphoric acid and hydrobromic acid or at least one organic acid selected from acetic acid, propionic acid, fumaric acid, malic acid and citric acid. The effect of ϵ-polylysine as an antibacterial agent is not substantially different between the free form and the salt form.

Such polylysine salt can be produced by a conventional method. Such polylysine salt is obtained, for example, by dissolving the aforementioned ϵ-polylysine into a hydrated methanol solution, followed by addition thereto of the aforementioned acid, and once the resulting solution has passed the neutralization point, adding cold acetone and drying the precipitated salt.

As the protamine according to the method of the present invention, a commercially available one can be used, and it may be originated from a variety of fishes such as salmon and herring.

Examples of the production method thereof include one in which fish testes are ground and protamine is extracted from the thus ground matter with a mineral acid, or one in which protamine is extracted directly from fish testes with a mineral acid without grounding them. In addition, there have been proposed a number of methods such as a salting-out method by addition of an alkaline agent, precipitation method by addition of condensed phosphate, precipitation method by an organic solvent such as ethanol, enzyme method, and purification method in which protamine is liberated and subsequently subjected to ion-exchange or electrodialysis. Further, methods such as those in which impurities are removed by adding an acid-soluble cationic polymeric flocculating agent to a mineral acid extract solution (Japanese Examined Patent Application Publication No. H7-86119, Japanese Patent No. 252161, Japanese Patent No. 2685424) have been reported. In the present invention, such protamine obtained by these extraction and purification methods can be used.

In the method according to the present invention, the step of immersing a textile product in an aqueous solution containing cationic polypeptide can be carried out by immersing the textile product into a pool of the cationic polypeptide aqueous solution. When doing so, it is preferred that the textile product be in the condition where it is completely submerged in the aqueous solution (there is no part exposed above the solution surface). As a result of this step, the aqueous solution sufficiently permeates the fibers of the textile product.

In the method according to the present invention, the concentration of the cationic polypeptide aqueous solution is preferably 250 ppm or more, more preferably 1,000 ppm or more, still more preferably 2,500 ppm or more. Further, since the effect reaches the plateau, the upper limit of the concentration is set at 5,000 ppm. Moreover, the total concentration of the components contained in the aforementioned aqueous solution other than the cationic polypeptide is preferably 5,000 ppm or less, and more preferably, such other components are not substantially contained.

This is because, as long as the concentration of the components other than the cationic polypeptide is in the aforementioned range, the adverse effect thereof on the bacteriostatic effect of the cationic polypeptide is minimized. Specifically, since a decrease in the pH of the aqueous solution due to organic acid or the like can be prevented, it is preferred that the content of such components be in the aforementioned range. The same is also applicable to organic acid salts, which are likely to affect the bacteriostatic effect by increasing the ionic strength. Further, the same is also applicable to anionic surfactants such as sodium dodecyl sulfate, which are a widely-used component in detergents.

In addition, it is preferred that the weight ratio of the textile product and the cationic polypeptide aqueous solution be 1:5 to 1:20.

Further, the pH of the cationic polypeptide aqueous solution is preferably more than 5, more preferably 6 or more, still more preferably 7 or more. When the pH of the cationic polypeptide aqueous solution is in the alkaline side, the bacteriostatic effect is less likely to be reduced.

In the method according to the present invention, the temperature of the cationic polypeptide aqueous solution is 25° C. or more, preferably 50° C. or more. The upper limit thereof is not particularly restricted, however, it is preferably 120° C., more preferably 75° C. As long as the upper limit is in this range, the cationic polypeptide remains stable even if heated for 20 minutes, and the effects of the present invention are less likely to be impaired.

In the method according to the present invention, the duration of immersing the textile product in the cationic polypeptide aqueous solution is 20 minutes or more. The immersion time can be any duration as long as it is long enough to allow the cationic polypeptide aqueous solution to sufficiently permeate the fibers of the textile product. The immersion time is more preferably 1 hour or more, still more preferably 2 hours or more, and the effect can be sufficiently attained with a duration of the step at not longer than 24 hours.

The material of the textile product upon which the method of the present invention is applied is not particularly restricted, and examples thereof include: natural fibers such as cotton, wool, hemp, silk and bamboo; regenerated cellulose fibers such as rayon and cupra; semi-synthetic fibers such as acetate and promix; synthetic fibers such as polyamide, polyester, acryl, polyolefin, polyvinyl chloride, polyurethane, polyimide and nylon; and composite fibers of these fibers. There is also no particular restriction on the form of these textile products, and examples thereof include short fiber, long fiber, yarn, woven fabric, knitted fabric, nonwoven fabric and paper.

If the textile product is subjected to the bacteriostatic treatment in accordance with the method of the present invention, the textile product retains the bacteriostatic effect even after being washed for a plurality of times. Specifically, the bactericidal activity value (L), which is evaluated in an antibacterial activity test after a prescribed number of washings in accordance with prescribed procedures, becomes 0 or larger. The method according to the present invention provides bacteriostatic effect against bacteria that can commonly attach to and propagate on textile products, and the bacteria are, for example, *Escherichia coli, Staphylococcus aureus, Klebsiella pneumoniae, Pseudomonas aeruginosa* and MRSA. Therefore, by the bacteriostatically treating method according to the present invention, a textile product having an antibacterial effect against the aforementioned bacteria (antibacterial textile product) can be produced.

It is noted here that, against *E. coli* and *S. aureus*, it is preferred that the concentration of the cationic polypeptide aqueous solution be 250 ppm or more.

Here, the bactericidal activity value (L) is defined by the following equation (for details, see the Approval Standard for Antibacterial and Deodorant Textile Products set forth by the Japan Textile Evaluation Technology Council (JTETC)). When this value (L) is ≥0, the textile product is considered to have an antibacterial effect, and it becomes eligible to be approved as a bacteriostatically treated textile product (with SEK Mark).

L (bactericidal activity value)=($M_a$−$M_c$)

$M_a$: Average common logarithm value of the viable cell count or the ATP amount, which was measured for three samples immediately after the inoculation thereof onto a standard cloth.

$M_c$: Average common logarithm value of the viable cell count or the ATP amount, which was measured for three samples after 18 hours of culturing on an antibacterially treated cloth.

EXAMPLES

The present invention will now be described in more detail by way of Examples; however, the present invention is not limited to those Examples.

In each of the tests described below, the antibacterial effect provided by the bacteriostatically treating method was examined in accordance with the following procedures.

Method of Impregnating Polycationic Polypeptide

Threads, each of which was cut into 0.4 g in weight, were used as the fiber samples. Into a polycationic polypeptide aqueous solution of a prescribed concentration which was heated to a prescribed temperature (25, 50 or 75° C.), the samples were immersed for a prescribed period of time. The followings were used as the polycationic polypeptide.

ϵ-polylysine:polylysine 25% aqueous solution: (Chisso Corporation)

protamine: protamine sulfate, originated from salmon (Wako Pure Chemical Industries, Ltd.)

Then, the fiber samples were washed by a simple method which was modified from the washing method according to JIS L-0217 103 ("Antimicrobial Agent of SENKA Corporation"; Everything about antimicrobial agents, p. 595-598, 1997, Sen-i Co., Ltd.), and the thus washed samples were dried in the air. The washing method was carried out by the following steps.

(1) Water having a temperature of 40° C. is filled into the washer water tank up to the highest line for the water level. To this water, "JAFET standard detergent (polyoxyethylene alkyl ether)" is added at a ratio of 40 mL of the detergent to 30 L of water to obtain washing solution.

(2) The fiber samples are placed into the washing solution in such a manner that the bath ratio (the weight ratio of the fibers and the washing solution at the time of washing of the fibers after the immersion) becomes 1:30, and the washing machine is operated for 25 minutes.

(3) The fiber samples are dehydrated by a dehydrator. The dehydration is carried out for 7 to 8 minutes.

(4) The washing solution is replaced with fresh water at room temperature, and rinsing and washing are performed in the filled water for 4 minutes at the same bath ratio.

(5) The fiber samples are dehydrated by a dehydrator. The dehydration is carried out for 7 to 8 minutes.

(6) Rinsing and washing are performed with running water for 2 minutes.

(7) Considering the above (1) to (6) as 5 washings, these steps are repeated twice to have the fiber samples be "washed 10 times".

(8) The fiber samples are dehydrated by a dehydrator.

<Antibacterial Test Method>

A bacterial suspension which was cultured in normal broth at 30° C. for 18 hours was mixed and diluted to prepare a diluted bacterial suspension having a concentration of $10^6$ cells/mL. Placed into a vial was 0.4 g of fiber sample which was not washed or washed 10 times. Thereto inoculated was 400 μL of the diluted bacterial suspension, which was then allowed to soak into the sample, and the sample was incubated at 37° C. After 18 hours, 20 mL of physiological saline was added to the vial and the resultant was stirred using a mixer (5 seconds×5 times) to suspend the bacterial cells. The thus obtained suspension was diluted as appropriate, and the number of bacterium was counted to calculate the bactericidal activity value (L) based on the aforementioned equation. Here, the tested bacteria were *E. coli* and *S. aureus*.

Example 1

Using cotton thread or wool thread as the fiber sample, the polycationic polypeptide concentration at which the antibacterial effect is attained (at which L≥0 is attained) was examined. Used as the polycationic polypeptide was ϵ-polylysine. The temperature of the aqueous solution was 50° C. or 75° C., the immersion time was 2 to 24 hours, and the ϵ-polylysine concentration was 500 to 30,000 ppm.

The results are shown in Table 1. As for the cotton thread and wool, the bacteriostatic effect against *E. coli* was attained under the immersion conditions of 50° C., 2 hours or more and 2,500 ppm of ϵ-polylysine aqueous solution, while the bacteriostatic effect against *S. aureus* was attained under the immersion conditions of 50° C., 2 hours or more and 500 ppm of ϵ-polylysine aqueous solution.

TABLE 1

| Fiber Name | Temperature | Immersion Time (hours) | ε-polylysine concentration at which L ≥ 0 was attained (ppm) *E. coli* | *S. aureus* |
|---|---|---|---|---|
| Cotton 100% | 50° C. | 2 | 2,500 | 500 |
| | | 3 | 2,500 | 500 |
| | | 24 | 2,500 | 500 |
| Wool 100% | | 2 | 2,500 | 500 |
| | | 3 | 2,500 | 500 |
| | | 24 | 2,500 | 500 |
| Cotton 100% | 75° C. | 2 | 2,500 | 500 |
| | | 3 | 2,500 | 500 |
| | | 24 | 2,500 | 500 |
| Wool 100% | | 2 | 2,500 | 500 |
| | | 3 | 2,500 | 500 |
| | | 24 | 2,500 | 500 |

Example 2

Using threads of various materials as the fiber samples, the polycationic polypeptide concentration at which the antibacterial effect is attained (at which L≥0 is attained) was examined. Used as the polycationic polypeptide was ϵ-polylysine. The temperature of the aqueous solution was 25° C., the immersion time was 2 to 24 hours, and the ϵ-polylysine concentration was 250 to 30,000 ppm.

The results are shown in Table 2. Against both of *E. coil* and *S. aureus*, the bacteriostatic effect was attained under the immersion conditions of 25° C., 2 hours or more and 500 ppm of ϵ-polylysine aqueous solution.

TABLE 2

| Fiber Name | Temperature | Immersion Time (hours) | ε-polylysine concentration at which L ≥ 0 was attained (ppm) *E. coli* | *S. aureus* |
|---|---|---|---|---|
| Hemp 100% | 25° C. | 2 | 500 | 500 |
| | | 3 | 500 | 500 |
| | | 24 | 800 | 250 |
| Polyester 100% | | 2 | 500 | 500 |
| | | 3 | 500 | 500 |
| | | 24 | 800 | 250 |
| Rayon 100% | | 2 | 500 | 500 |
| | | 3 | 500 | 500 |
| | | 24 | 250 | 250 |
| Acryl 100% | | 2 | 500 | 500 |
| | | 3 | 500 | 500 |
| | | 24 | 250 | 250 |
| Nylon 100% | | 2 | 500 | 500 |
| | | 3 | 500 | 500 |
| | | 24 | 250 | 250 |

INDUSTRIAL APPLICABILITY

By using the method according to the present invention, a textile product can be bacteriostatically treated in such a manner that the bacteriostatic effect imparted by the cationic polypeptide is not reduced and thus retained even after the textile product is washed for a plurality of times; therefore, the method according to the present invention is industrially very useful.

The invention claimed is:

1. A method for bacteriostatically treating a textile product, comprising the steps of:

preparing an aqueous solution consisting essentially of water and ϵ-polylysine that comprises ≥60 mol % of a basic amino acid as the main component of the ϵ-polylysine, wherein the basic amino acid is lysine and the molecular weight range of the ϵ-polylysine is between 1,000 and 5,000, wherein the concentration of the ϵ-polylysine in the solution is between 250 ppm and 5,000 ppm, wherein pH of the solution is ≥7, and wherein temperature of the solution is ≤120° C.; and immersing a textile product into the solution for ≥1 hour wherein the textile product maintains its bacterio static effect for at least 10 washings.

2. The bacteriostatically treating method according to claim 1, wherein the temperature of the solution is ≤75° C.

3. The bacteriostatically treating method according to claim 1, wherein the concentration of ϵ-polylysine is ≥2,500 ppm.

4. The bacteriostatically treating method according to claim 1, wherein the duration of said immersion is ≥2 hours.

5. The bacteriostatically treating method according to claim 1, wherein weight ratio of the textile product and the ϵ-polylysine aqueous solution is 1:5 to 1:20.

6. The method of claim 1 wherein the solution of ϵ-polylysine consists essentially of a basic amino acid as the main component of the ϵ-polylysine.

* * * * *